US006500099B1

(12) United States Patent
Eschenbach

(10) Patent No.: US 6,500,099 B1
(45) Date of Patent: Dec. 31, 2002

(54) RECUMBENT ABDOMINAL EXERCISE APPARATUS

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 141 days.

(21) Appl. No.: 09/625,212

(22) Filed: Jul. 24, 2000

(51) Int. Cl.[7] ..... A63B 21/00
(52) U.S. Cl. ..... 482/57; 482/51; 482/121
(58) Field of Search ..... 482/51, 57, 58, 482/59, 60, 63, 64, 121, 122, 126, 124, 140, 53

(56) References Cited

U.S. PATENT DOCUMENTS

| | | | | |
|---|---|---|---|---|
| 2,924,214 A | | 2/1960 | Zak | |
| 4,240,627 A | | 12/1980 | Brentham | |
| 4,465,274 A | | 8/1984 | Davenport | |
| 4,519,604 A | | 5/1985 | Arzonnian | |
| 4,538,804 A | | 9/1985 | Zibell | |
| 4,550,908 A | | 11/1985 | Dixon | |
| 4,684,126 A | | 8/1987 | Dalebout | |
| 4,717,146 A | | 1/1988 | Noharan | |
| 4,809,976 A | | 3/1989 | Berger | |
| 4,974,840 A | | 12/1990 | Welch | |
| 5,038,758 A | * | 8/1991 | Iams et al. | 482/57 |
| 5,039,088 A | | 8/1991 | Shifferaw | |
| 5,215,511 A | * | 6/1993 | Cheng | 482/121 |
| 5,279,530 A | | 1/1994 | Hess | |
| 5,505,679 A | | 4/1996 | McBride | |
| 5,618,247 A | * | 4/1997 | Perez | 482/60 |
| 5,746,681 A | * | 5/1998 | Bull | 482/51 |
| 6,270,446 B1 | * | 8/2001 | Abelbeck et al. | 482/51 |

FOREIGN PATENT DOCUMENTS

| | | |
|---|---|---|
| CH | 442103 | 1/1968 |
| GB | 403165 | 12/1933 |

OTHER PUBLICATIONS

Top 10 Abdominal Exercises, Club Industry Magazine, May, 2000, p. 69.

* cited by examiner

*Primary Examiner*—Stephen R. Crow
*Assistant Examiner*—Tam M Nguyen

(57) ABSTRACT

The present invention relates to the field of pull/push exercise with an exercise machine that exercises the abdominal, back and leg muscles with the operator recumbent in the face upwards position. Foot contacts follow an arcuate curve path positioned above the recumbent operator. Resistance is provided for each foot contact where the abdominal muscles of the operator pull the lower leg contact or foot contact towards the operator.

Handles are provided to support the arms of the operator.

22 Claims, 6 Drawing Sheets

RECUMBENT ABDOMINAL EXERCISE APPARATUS

BACKGROUND OF THE INVENTION

1. Field

The present invention relates to the field of recumbent leg pull exercise apparatus. More particularly, the present invention relates to an exercise apparatus that exercises the abdominal, back and leg muscles with the operator prone on his back whereby the feet follow an arcuate curve with pull/push movement.

2. State of the Art

The benefits of regular exercise to improve overall health, appearance and longevity are well documented in the literature. One of the most difficult muscle groups to exercise is the abdominals. For exercise enthusiasts the search continues for safe apparatus that provides exercise to tone the abdominals without back strain.

Many devices have appeared recently to aid the user in the performance of situps from a prone face-up position with the intent of easing back strain. Situps, even with assistive devices, have low appeal and often the devices find their way to a permanent storage area.

Devices to aid the sit-up movement such as Evans in U.S. Pat. No. 5,120,052, Steinmetz in U.S. Pat. No. 5,419,750 and Brown in U.S. Pat. No. 5,577,987, as just a few, that provide for a recumbent operator to contract the abdominals while raising the upper body with the aid of such device. Another group of abdominal exercise aids such as Boland in U.S. Pat. No. 5,759,138, Conner in U.S. Pat. No. 5,766,118 and Hern in U.S. Pat. No. 6,013,014 start in a seated posture and lean forward against the resistance of an apparatus. Oeglaend in German Pat. No. 3631622 shows an adjustable bench with cable for exercise.

Another abdominal exercise method developed by the Royal Canadian Air Force requires a person to start in a kneeling position on hands and knees, then push his body forward, sliding out along his hands until prone with arms extended. The exerciser then returns to the kneeling position by reversing the sliding action. This is a most difficult exercise and would not be embraced by the average exercise participant.

The simplest kneel-prone-kneel device is the classic exercise wheel. Shiek et al. in U.S. Pat. No. D306,886 shows a pair of wheels rollably attached to a straight rod used for hand grip. Mattox in U.S. Pat. No. 5,261,866 adds elastic tubing to the handles where the knees hold the tubing while the operator is in the push mode to assist in the return mode. A spiral spring is added to the exercise wheel in R.O.C. Pat. 276503 and to a pair of wheels by Barbeau in U.S. Pat. No. 2,821,394.

Semi-recumbent cycles such as Chang in U.S. Pat. No. 6,001,046, Praprotnik in U.S. Pat. No. 4,222,376, Bostic et al. in U.S. Pat. No. D353,422, Dranselka in U.S. Pat. No. 4,262,902 and Jennings in U.S. Pat. No. 4,776,583 show simple bicycle cranks to be operated from a seated position with the hip above or about the same level as the crank.

Another group of cycles intended to be ridden from the recumbent position such as Mousel in U.S. Pat. No. 4,601,464, Dranselka in U.S. Pat. No. 4,739,984, McJunkin, Jr. et al. in U.S. Pat. No. 4,925,184, Shibata in U.S. Pat. No. 5,743,050, Kock in U.S. Pat. No. 4,979,737 and Douglas in U.S. Pat. No. 4,169,591 are simple bicycle cranks attached to a bed by different means.

Recently several semi-recumbent cycles such as Stearns et al. in U.S. Pat. No. 6,077,197, Maresh in U.S. Pat. Nos. 5,707,321 and 5,938,570, Eschenbach in U.S. Pat. No. 5,836,855 and Rodgers, Jr. in U.S. Pat. No. 5,611,758 have added elliptical foot movement to a seated semi-recumbent operator.

Noharan in U.S. Pat. No. 4,717,146, Zibell in U.S. Pat. No. 4,538,804 and Welch in U.S. Pat. No. 4,974,840 show rotary cranks above the operator from adjustable bench positions. Arzonnian in U.S. Pat. No. 4,519,604 shows a rotary crank above a recumbent operator where the crank axis and bench oscillate.

Hess in U.S. Pat. No. 5,279,530, Dixon in U.S. Pat. No. 4,550,908, Zak in U.S. Pat. No. 2,924,214 and McKenzie in UK Pat. No. 403165 show foot contacts that slide away from an operator prone or seated against resistance.

Brentham in U.S. Pat. No. 4,240,627, Davenport in U.S. Pat. No. 4,465,274, Dalebout et al. in U.S. Pat. No. 4,684,126, Berger in U.S. Pat. No. 4,809,976, McBride et al. in U.S. Pat. No. 5,505,679, Shifferaw in U.S. Pat. No. 5,039,088 and Moreillon in Swiss Pat. No. 442103 show swing arms for the feet to operate in a seated position.

One of the top 10 abdominal exercises listed by Club Industry Magazine, May, 2000, page 69, lists number 7 as the "Bicycle". The article gives the following directions: "lie on back and lift knees to a 90 degree angle from the floor; Bring the right knee in to the left elbow as the left leg extends; Repeat on the other side; Continue to alternate while keeping abdominals contracted". Observation of this exercise shows that the feet can follow an arcuate path instead of a circular bicycle path. The abdominals are exercised because the feet are moved towards the exerciser.

None of the prior art reviewed including samples above address the number 7 exercise with the feet moving along an arcuate curve path while recumbent with knees bent above the upper body operating with resistance. One of the objectives of the present invention is to provide a back and forth movement for the feet where one foot pulls toward the operator against resistance along an arcuate curve path while the other foot pushes away from the upper body along the arcuate path as the leg extends. Another objective of this invention is to provide pull/push apparatus motion which exercises the abdominals, back and leg muscles in a novel manner without back strain.

SUMMARY OF THE INVENTION

One objective of the present invention is to provide a pair of lower leg or foot contacts that can be pulled by the abdominal muscles towards the recumbent operator. Another objective of the present invention is to provide means whereby either the ankle, instep or the bottom of the foot can be used by the prone operator for back and forth movement. Another objective of the present invention is to provide a heel support while the foot follows an arcuate path during exercise. Another objective of the present invention is to provide handles for the hands during operation of the exercise apparatus. Another objective of the present invention is to provide an adjustable bench to vary the incline of the back of the operator.

The present invention is intended for a recumbent operator having back downward with knees bent where the feet move along an arcuate curve path located above the torso of the operator. An adjustable bench is provided to support the back while the hip area is supported by a seat. A framework supports the seat, bench and a pair of guide links. The feet are positioned in a pair of foot contacts guided by each guide link to follow an arcuate curve path. An adjustable resistance is imposed upon the guide links.

The lower leg contacts are configured to allow the abdominal muscles to pull one foot towards a recumbent operator against the resistance as the knee bends while the other foot pushes away from the operator as the leg extends. The feet alternately pull and push the lower leg contacts to exercise the leg muscles as well as the abdominals.

In the preferred embodiment, the lower leg contacts are elongated foot contacts pivotally connected to a guide link and a stabilizer link. Both the guide link and stabilizer link are pivoted to the framework about the same height as the hip for each foot contact. An adjustable damping cylinder is pivotally attached to each stabilizer link and the framework. The guide link and stabilizer link are approximately the same length as the upper leg. Therefore, the lower leg and foot contact have only a small amount of relative angular movement during exercise. This allows the foot contact to be in contact with the instep, back of the heel and the bottom of the foot with out twisting the ankle. A bench adjustment is included to vary the incline of the back of the operator.

In an alternate embodiment, the lower leg contact is a foot contact in the form of pedals and foot straps to allow the foot to pull on the guide links. Resistance is by an elastic member adjustably attached to the guide link and the framework of base.

Both the preferred and alternate embodiment are shown with independent guide links whereby the feet can operate opposed or in unison. The following embodiments show how the guide links can be made dependent.

In another alternate embodiment, the lower leg contact becomes an ankle cuff with velcro type material to hold the closing strap. The ankle cuffs are connected to the guide links by cable or rigid pivotable links. Each guide link is pivotally connected to a coupling link which is pivotally connected to a reversing link that is pivotally connected to the framework. Movement of one guide link causes the other guide link to move in the opposite direction. A pair of friction discs are attached to the reversing link with an adjustment knob to add resistance.

In yet another embodiment, the coupling links and reversing link are replaced with a pair of pulleys engaged with cable that is attached to the guide links. Guide links move in opposite directions.

It should be obvious that each embodiment of the present invention can be modified within the scope of the present invention to have either dependent or independent guide link movement.

Each embodiment includes ankle cuffs or foot contacts that move along arcuate curves above the recumbent operator. The length of the curve is determined by the operator. The feet move with a pull/push motion against adjustable resistance. Handles are provided in each embodiment to accommodate the hands of the operator. In any of the above embodiments, the bench can be adjusted to incline the back for the exercise of different muscles.

Each of the embodiments shown contains a minimum number of elements that comprise the linkage to guide the foot contacts along an arcuate curve path. It should be obvious that linkage systems having additional elements can also be used to guide the feet along an arcuate path and are considered within the scope of the present invention.

Each of the embodiments provide pull/push apparatus motion which exercises the abdominals, back and leg muscles in a novel manner without back strain.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 6, is not intended to limit the scope of the invention, as claimed, but is merely representative of the presently preferred embodiments of the invention.

Figure 1:
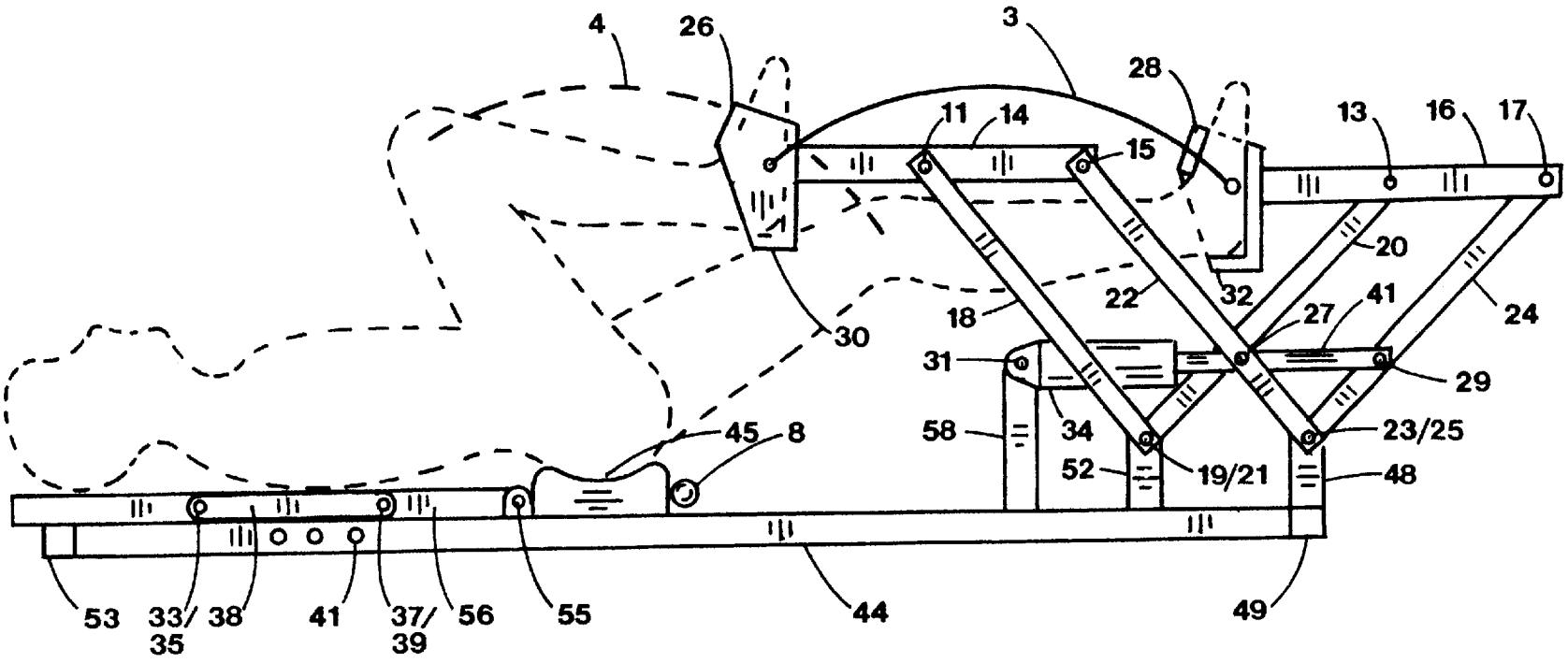
FIG. 1 is a side elevation view of the preferred embodiment of the present invention.
Figure 2:
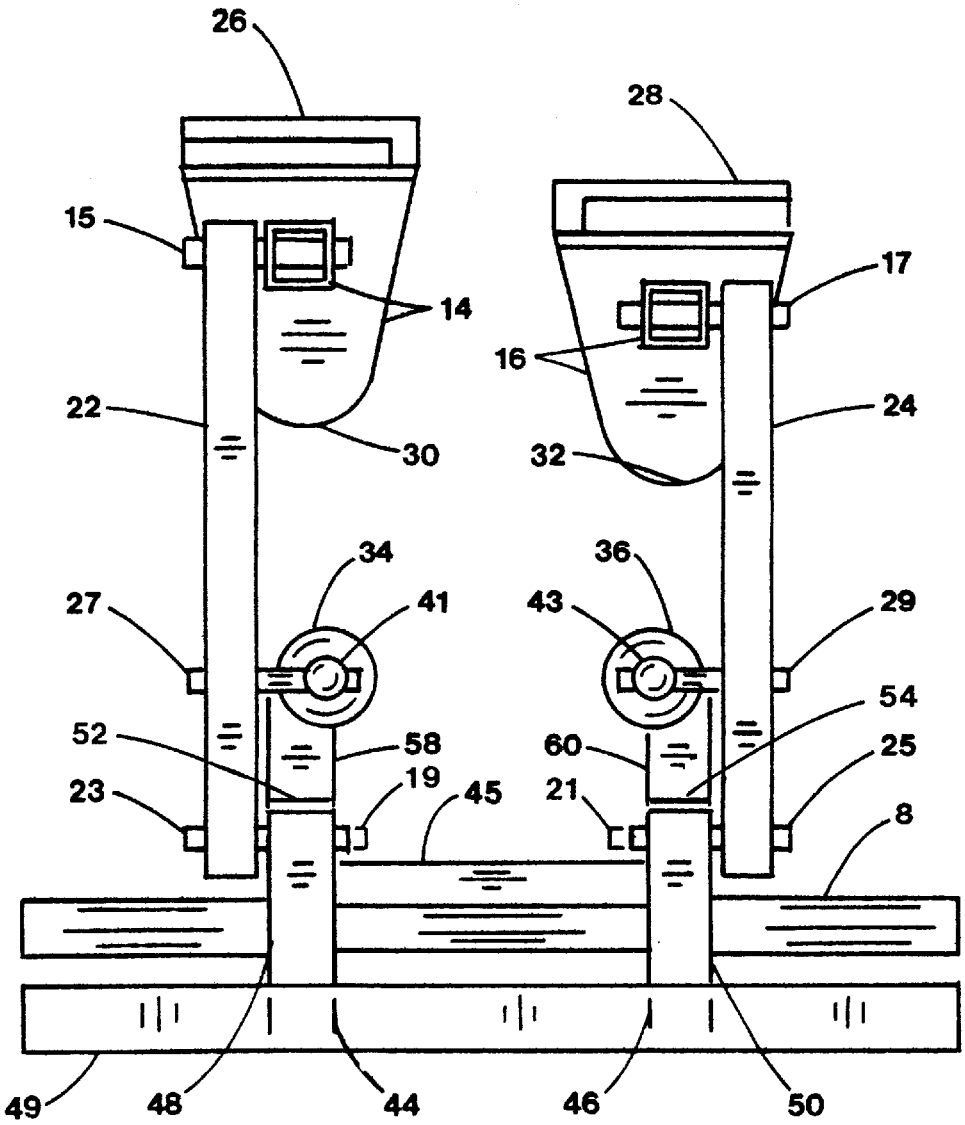
FIG. 2 is an enlarged end view of the preferred embodiment shown in FIG. 1.

In the preferred embodiment shown in FIGS. 1 and 2, the lower leg contacts are shown as elongated foot contacts 14,16 with the legs of the operator most bent and most extended. Foot contacts 14,16 include instep pads 26,28 and back of heel supports 30,32. Foot contacts 14,16 are connected to guide links 18,20 at pivots 11,13 and to stabilizer links 22,24 at pivots 15,17. Guide links 18,20 are connected with frame members 52,54 at pivots 19,21 and stabilizer links 22,24 are connected to frame members 48,50 at pivots 23,25. The guide links 18,20 and stabilizer links 22,24 are approximately the same length as the upper leg of the operator. Further, the distance between pivots 11–15, 13–17, 19–23 and 21–25 are approximately the same. Therefore, each lower leg and corresponding foot contact 14,16 moves with nearly parallel motion for only a small amount of ankle angular movement.

Adjustable dampers 34,36 are attached to the stabilizing links 22,24 at pivots 27,29 and to frame members 58,60 at pivots 31. Frame members 53,49 are in contact with the floor and are connected by frame members 44,46. Frame members 48,50,52,54,58,60 are attached to frame members 44,46. Seat 45 is attached to frame members 44,46. Bench 56 is attached to frame members 44,46 at pivot 55 and can be incline adjusted with links 38,40 using screws 33,35 and screws 37,39 in holes 41.

The knee curve 4 has about the same radius as the foot curve 3. The length of curve 3 is independently determined by the operator. Handles 8 are provided to support the arms.

Figure 3:
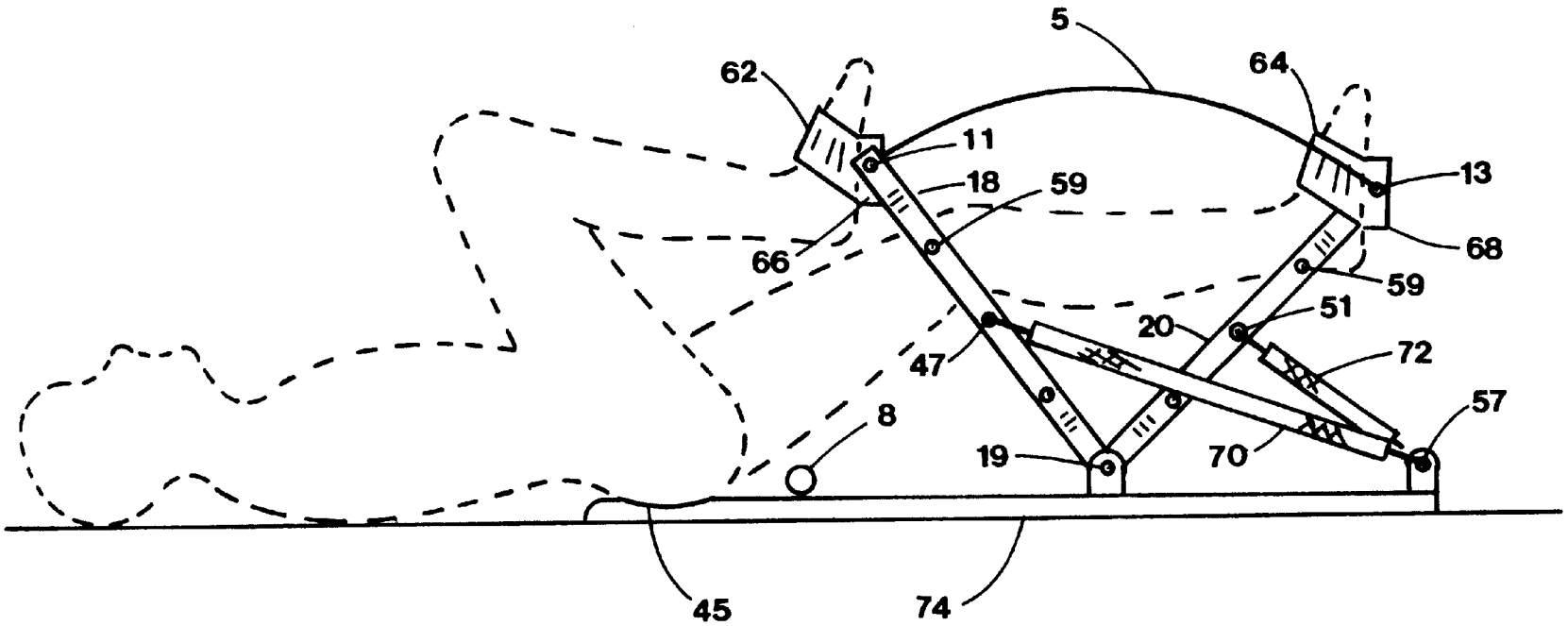
FIG. 3 is a side elevation view of an alternate embodiment of the present invention.

An alternate embodiment is given in FIG. 3 with guide links 18,20 in opposing positions. The lower leg contacts take the form of pedals 66,68 with foot straps 62,64 connected to guide links 18,20 at pivots 11,13. Guide links 18,20 are connected to base 74 at pivots 19,21. Elastic members 70,72 are attached to guide links 18,20 at pivot holes 47,51 and to base 74 at pivot hole 57. Other pivot holes 59 allow more or less movement of the elastic members 70,72 for variable resistance. Base 74 provides a seat 45 and handles 8 for the operator. In this case, the operator has the back supported by the floor. The feet move along arcuate curve 5.

Figure 4:
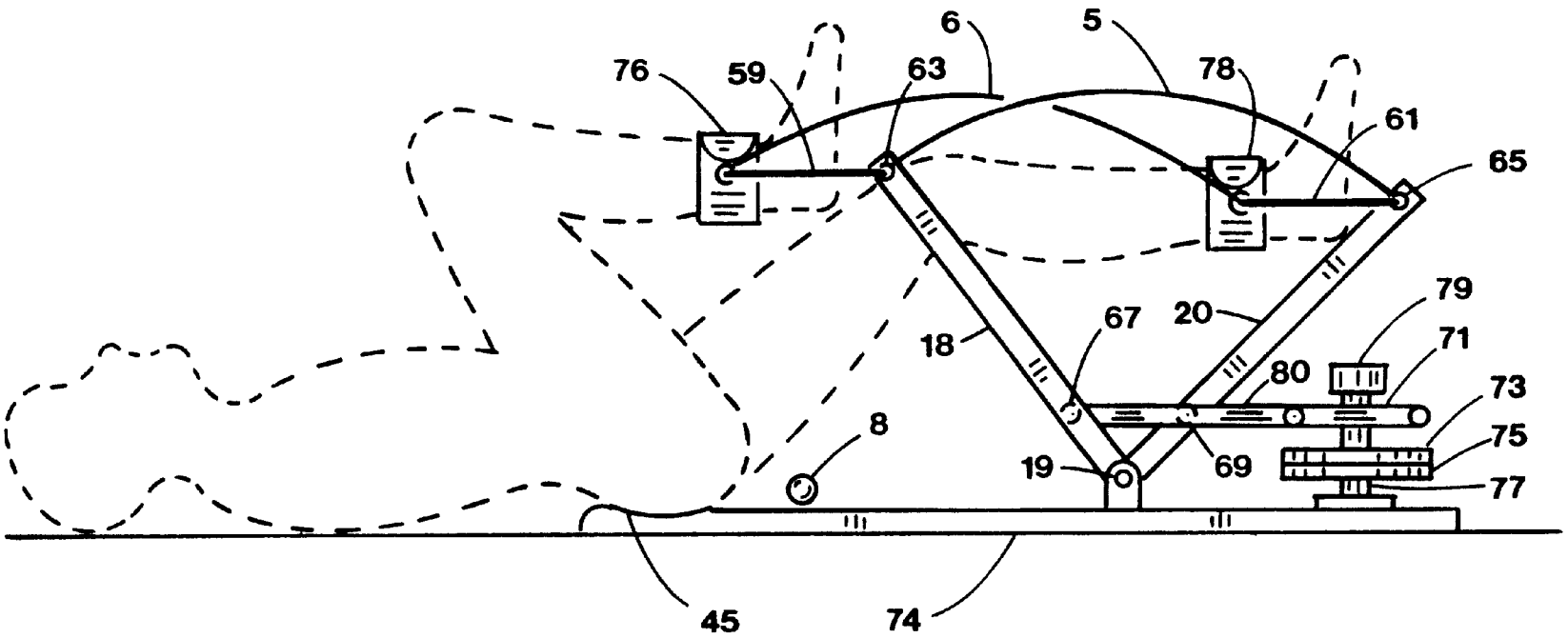
FIG. 4 is a side elevation of another alternate embodiment of the present invention.
Figure 5:
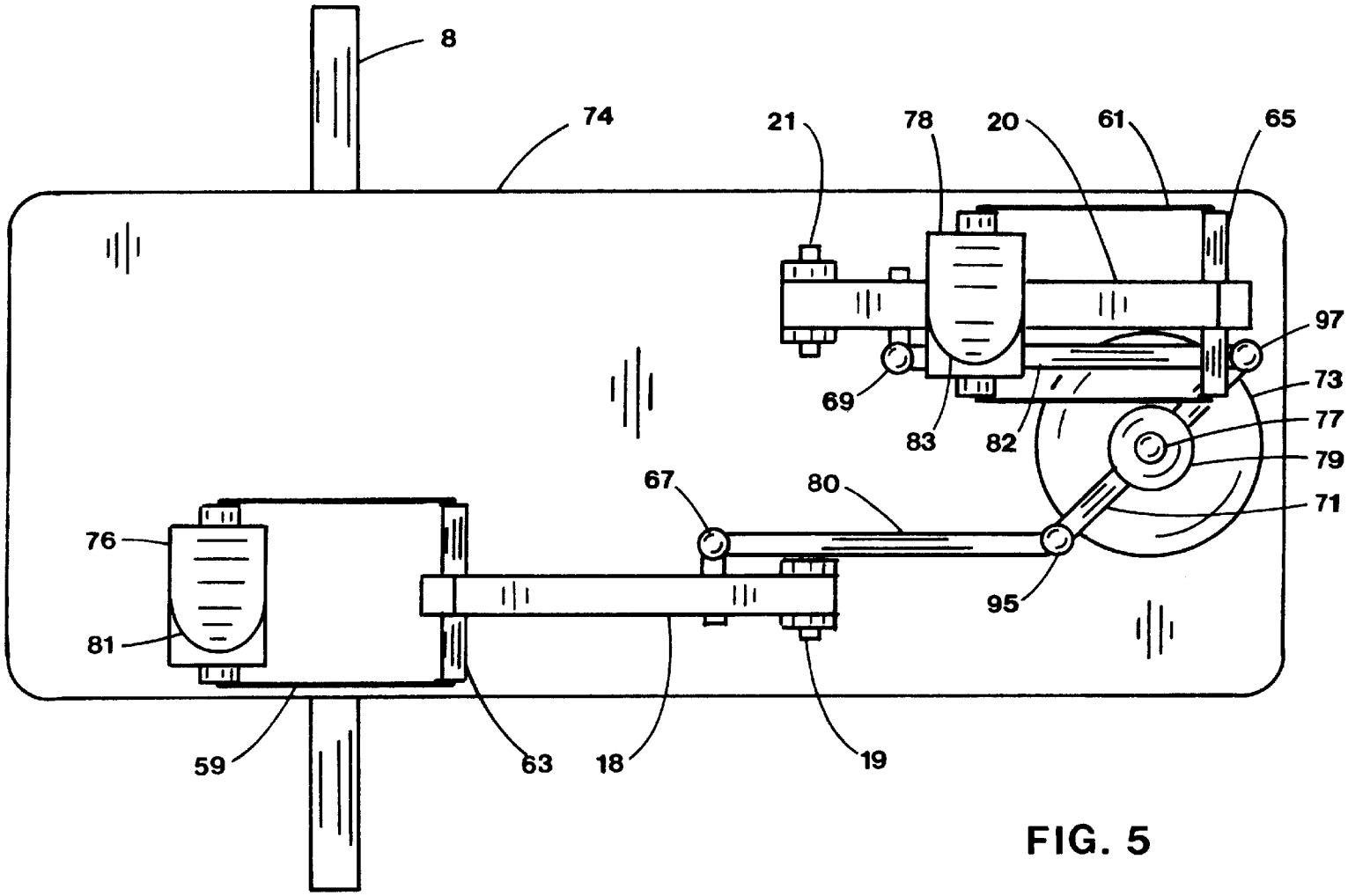
FIG. 5 is a plan view of the alternate embodiment shown in FIG. 4.

An other alternate embodiment is shown in FIGS. 4 and 5 where the lower leg contacts are ankle cuffs 76,78 which have adjustment straps 81,83 to wrap the ankles proximate the foot. Ankle cuffs 76,78 are connected to guide links 18,20 at tubes 63,65 by cables 59,61. Guide links 18,20 are connected to base 74 at pivots 19,21. Coupler links 80,82 are connected to guide links 18,20 with ball joints 67,69 and to reversing link 71 with ball joints 95,97. Reversing link 71 is connected to base 74 at pivot shaft 77 and to friction disc 73 which is in contact with stationary disc 75. Adjustment of knob 79 determines the normal force acting between discs 73,75 to vary the rotary resistance.

Figure 6:
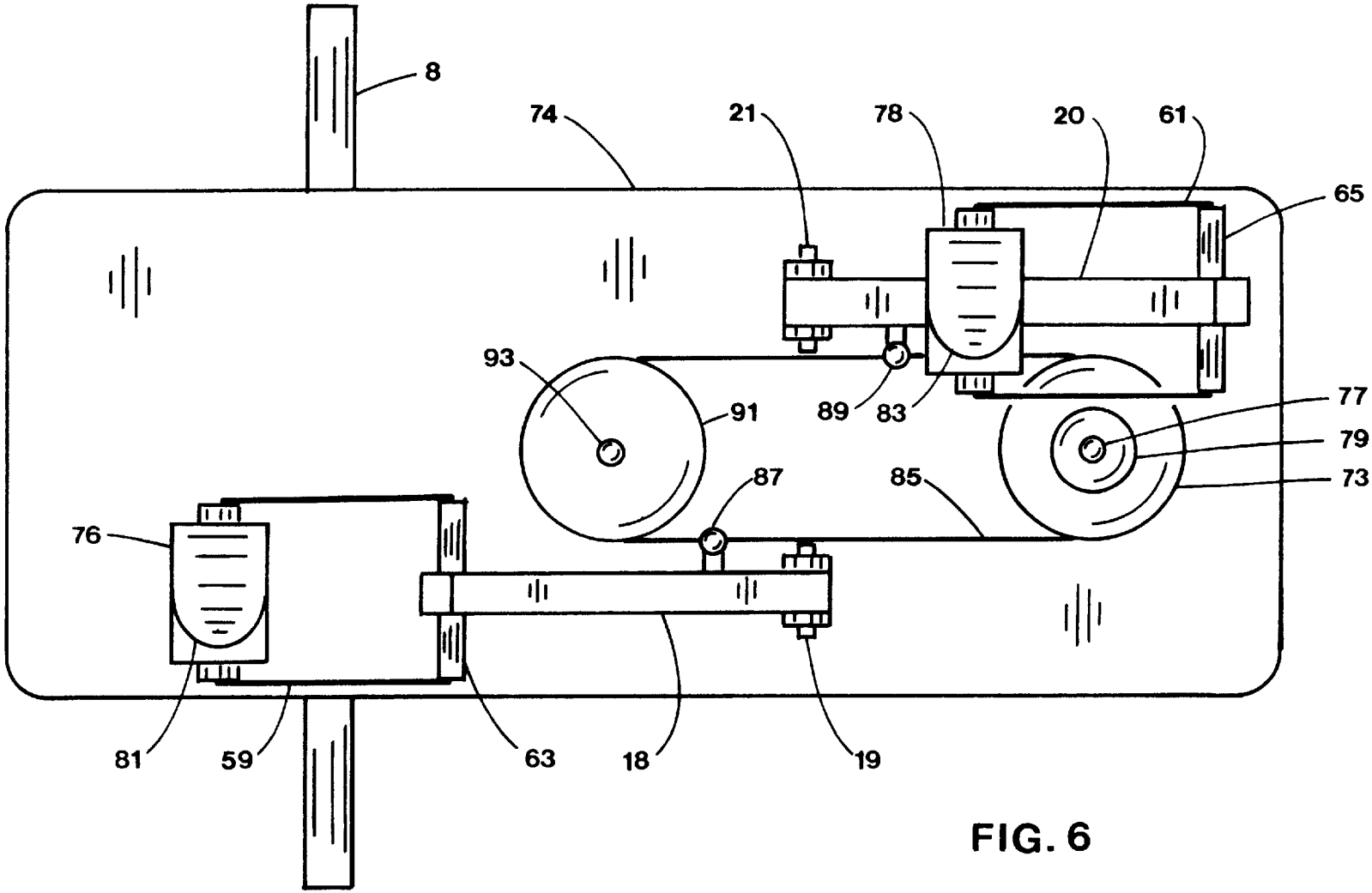
FIG. 6 is a plan view of another alternate embodiment of the present invention.

In another embodiment shown in FIG. 6, the coupler links 80,82 of the previous embodiment have been replaced with cable 85 engaged with pulleys 91,73 connected to base 74 at pivots 93,77. Cable 85 is connected to guide links 18,20 at pivots 87,89. The remainder of the embodiment is the same as shown in FIG. 4.

Each of the embodiments provide pull/push apparatus motion which exercises the abdominals, back and leg muscles in a novel manner without back strain. Arms may be used for support during exercise.

It should be understood that the elements disclosed in any one embodiment may be used in any of the other embodiments given. The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine for allowing a recumbent operator to move each foot back and forth comprising;

a framework, said framework configured to be supported by a generally horizontal surface;

a first arcuate curve path, said first arcuate curve path followed by the reciprocating movement of the knee of said recumbent operator;

a second arcuate curve path, said second arcuate curve path followed by the reciprocating movement of said foot of said recumbent operator;

a guide link for each foot of said recumbent operator, said guide link pivotally connected to said framework below said second arcuate curve path wherein a portion of said guide link follows said second arcuate curve path;

a stabilizer link, said stabilizer link pivotally connected to said lower leg contact and said framework whereby said stabilizer link controls the angular movement of said lower leg contact;

a pair of lower leg contacts, each said lower leg contact operably associated with said portion of said guide link;

said lower leg contact configured to move relative to said framework when the foot of said recumbent operator applies force upon said guide link whereby said first arcuate curve path and said second arcuate curve path have generally similar radius of curvature and orientation positioned above the hip of said recumbent operator.

2. The exercise machine according to claim 1 wherein said lower leg contact comprises a means for the upper portion of said foot of said recumbent operator to apply force upon said guide link.

3. The exercise machine according to claim 1 further comprising a means for resistance, said means for resistance operably associated with said guide link and said framework.

4. The exercise machine according to claim 3 wherein said means for resistance comprises an adjustable damping means for variable resistance.

5. The exercise machine according to claim 3 wherein said means for resistance comprises an elastic member adjustably associated with said guide link and said framework for variable resistance.

6. The exercise machine according to claim 3 wherein said means for resistance comprises adjustable friction members operably associated with said guide links for variable resistance.

7. The exercise machine according to claim 1 further comprising a heel support, said heel support attached to said lower leg contact wherein each heel of said recumbent operator rests on said heel support as said foot of said recumbent operator is used to move said guide link.

8. The exercise machine according to claim 1 further comprising a bench to support the back of said recumbent operator, said bench having a means to adjust said bench to vary the angle of said bench relative to the horizontal.

9. The exercise machine according to claim 1 wherein said lower leg contacts comprise a pair of pedals, each said pedal pivotally connected to said portion of said guide link.

10. The exercise machine according to claim 1 further comprising a pair of handles, each said handle attached to said framework to provide upper body support during exercise.

11. An exercise machine for use with the operator generally in a prone position with the back of said operator downward, comprising;

a framework, said framework configured to be supported by a surface;

an arcuate curve path, said arcuate curve path followed by the reciprocating movement of said foot of said operator;

a guide link for each foot of said operator, each said guide link pivotally connected to said framework below said arcuate curve path wherein a portion of said guide link follows said arcuate curve path;

a pair of lower leg contacts, each said lower leg contact operably associated with said portion of said guide link;

a stabilizer link, said stabilizer link pivotally connected to said lower leg contact and said framework whereby said stabilizer link controls the angular movement of said lower leg contact;

said lower leg contact configured to move relative to said framework when the lower leg of said operator applies force upon said guide link whereby the lower leg of said operator remains generally horizontal as said foot of said operator follows said arcuate curve path.

12. The exercise machine according to claim 11 wherein said lower leg contact comprises a means for the upper portion of said foot of said operator to apply force upon said guide link.

13. The exercise machine according to claim 11 further comprising a means for resistance, said means for resistance operably associated with said guide link and said framework.

14. The exercise machine according to claim 13 wherein said means for resistance comprises an adjustable damping means for variable resistance.

15. The exercise machine according to claim 13 wherein said means for resistance comprises an elastic member adjustably associated with said guide link and said framework for variable resistance.

16. The exercise machine according to claim 11 further comprising a pair of foot straps, each said foot strap connected to said lower leg contact wherein said foot strap allows the abdominal muscles of the operator to move said guide link towards said operator.

17. The exercise machine according to claim 11 wherein said lower leg contact comprises a pair of pedals, each said pedal pivotally connected to one end of said corresponding guide link.

18. An exercise machine for allowing each foot of a recumbent operator to have back and forth movement comprising;

a framework, said framework configured to be supported by a generally horizontal surface;

a pair of elongated foot contacts, each said elongated foot contact configured to transfer force from the lower leg of said recumbent operator;

a guide link for each said elongated foot contact, said guide link pivotally connected to corresponding said elongated foot contact and to said framework;

a stabilizer link for each said elongated foot contact, said stabilizer link pivotally connected to corresponding said elongated foot contact and to said framework;

said elongated foot contact configured to move relative to said framework when said foot of said recumbent operator is moving said elongated foot contact whereby said back and forth movement of said elongated foot contact maintains said foot of said recumbent operator at approximately the same elevation from said horizontal surface as the knee of said recumbent operator.

19. The exercise machine according to claim 18 wherein said elongated foot contact comprises a means for the upper portion of the foot of said recumbent operator to apply force upon said guide link.

20. The exercise machine according to claim 18 further comprising a means for resistance, said means for resistance operably associated with said elongated foot contact and said framework.

21. The exercise machine according to claim 18 wherein said guide links move independently of each other.

22. The exercise machine according to claim 18 further comprising a pair of handles, each said handle attached to said framework to provide upper body support during exercise.

* * * * *